US009875676B2

(12) United States Patent
Byun et al.

(10) Patent No.: US 9,875,676 B2
(45) Date of Patent: Jan. 23, 2018

(54) DISPLAY DEVICE AND METHOD OF INSPECTING THE SAME

(71) Applicant: SAMSUNG DISPLAY CO., LTD., Yongin-si, Gyeonggi-do (KR)

(72) Inventors: Min Woo Byun, Yongin-si (KR); Seung Kyu Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 10 days.

(21) Appl. No.: 15/063,797

(22) Filed: Mar. 8, 2016

(65) Prior Publication Data

US 2016/0372017 A1 Dec. 22, 2016

(30) Foreign Application Priority Data

Jun. 16, 2015 (KR) ..... 10-2015-0085456

(51) Int. Cl.
*G09G 3/36* (2006.01)
*G09G 3/00* (2006.01)
*G09G 3/20* (2006.01)

(52) U.S. Cl.
CPC ..... *G09G 3/006* (2013.01); *G09G 3/20* (2013.01); *G09G 2300/08* (2013.01); *G09G 2310/0297* (2013.01); *G09G 2320/0233* (2013.01); *G09G 2330/12* (2013.01)

(58) Field of Classification Search
USPC ..... 345/76–77, 100, 87
See application file for complete search history.

(56) References Cited

U.S. PATENT DOCUMENTS 6,441,561 B1 8/2002 Tsai
2011/0025678 A1* 2/2011 Chung ..... G09G 3/3233 345/213
2011/0080173 A1* 4/2011 Kim ..... G09G 3/006 324/403
2013/0083457 A1 4/2013 Wurzel et al.
2014/0176844 A1 6/2014 Yanagisawa
2014/0198202 A1 7/2014 Kim

FOREIGN PATENT DOCUMENTS

JP 2014-122974 A 7/2014
KR 10-2014-0091916 A 7/2014

* cited by examiner

*Primary Examiner* — Roy Rabindranath
(74) *Attorney, Agent, or Firm* — Lewis Roca Rothgerber Christie LLP

(57) ABSTRACT

A display device according to one or more embodiments of the present disclosure includes a plurality of pixels located at crossing regions of a plurality of scan lines and a plurality of data lines; a data driver coupled to ends of the plurality of data lines at a first side and configured to supply a plurality of data signals to the plurality of data lines; an inspection unit coupled to ends of the plurality of data lines at a second side and configured to supply a plurality of inspection signals to the plurality of pixels; at least one detection line electrically coupled to the inspection unit and extending from a first side of the panel to a second side of the panel; and a reset transistor coupled between the detection line and a reset power supply and configured to turn on when it receives a first control signal.

19 Claims, 9 Drawing Sheets

DISPLAY DEVICE AND METHOD OF INSPECTING THE SAME

CROSS-REFERENCE TO RELATED APPLICATION

This application claims priority to, and the benefit of, Korean Patent Application No. 10-2015-0085456, filed on Jun. 16, 2015, in the Korean Intellectual Property Office, the contents of which are incorporated herein by reference in their entirety.

BACKGROUND

1. Field

Embodiments of the present disclosure relate to a display device and a method of inspecting the display device.

2. Description of the Related Art

As information technology has been developed, a display device that is a communication medium between a user and information has become increasingly popular. As such, a display device, such as a liquid crystal display device or an organic light emitting display device, is widely used.

In general, panels of a display device are formed on a mother substrate, and by scribing the mother substrate, the panels are separated into several panels. However, in the process of cutting the mother substrate, the periphery of the panel may be cracked. Thus, a method of detecting a crack of the panel of the display device is desired. In addition, a flexible panel is mounted in the display device, and thus a method of detecting a crack of the flexible panel is desired.

SUMMARY

Embodiments of the present disclosure provide a display device which can detect a crack of a panel, and a method of inspecting the display device.

A display device according to one or more embodiments of the present disclosure includes: a plurality of pixels located at crossing regions of a plurality of scan lines and a plurality of data lines; a data driver coupled to ends of the plurality of data lines at a first side and configured to supply a plurality of data signals to the plurality of data lines; an inspection unit coupled to ends of the plurality of data lines at a second side and configured to supply a plurality of inspection signals to the plurality of pixels; at least one detection line electrically coupled to the inspection unit and coupling a first side of a panel to a second side of the panel; and a reset transistor coupled between the detection line and a reset power supply and configured to turn on in response to a first control signal.

According to one or more exemplary embodiments, a voltage of the reset power supply may be lower than that of the data signals supplied from the data driver.

According to one or more exemplary embodiments, the voltage of the reset power supply may be lower than that of a data signal of white.

According to one or more exemplary embodiments, the display device may further include a scan driver configured to supply a plurality of scan signals to the plurality of scan lines.

According to one or more exemplary embodiments, the plurality of pixels may include a first pixel configured to display a first color; a second pixel configured to display a second color; and a third pixel configured to display a third color.

According to one or more exemplary embodiments, the first color may be red, the second color may be blue, and the third color may be green.

According to one or more exemplary embodiments, the inspection unit may include a first control transistor coupled between ends of a first side of the detection lines and a specific data line coupled to the third pixel, and the first control transistor may be configured to turn on in response to a second control signal; and a second control transistor coupled between ends of a second side of the detection lines and a third inspection line that is configured to supply an inspection signal to the third pixel, and the second control transistor may be configured to turn on in response to the second control signal.

According to one or more exemplary embodiments, the first control signal may not overlap with the second control signal.

According to one or more exemplary embodiments, the data driver may be configured to supply a data signal of white when the first control signal is supplied during a first period of inspection, and a voltage corresponding to a data signal of black may be supplied to the third inspection line and the data driver may sequentially supply the plurality of scan signals to the plurality of scan lines during a second period of inspection.

According to one or more exemplary embodiments, the display device may further include a demultiplexer unit coupled between the data driver and the plurality of data lines.

According to one or more exemplary embodiments, the demultiplexer unit may include first switching elements coupled to respective ones of the data lines that are coupled to the first pixels; second switching elements coupled to respective ones of the data lines that are coupled to the second pixels; and third switching elements coupled to respective ones of the data lines that are coupled to the third pixels, and wherein the third switching elements may be turned on during the first period.

According to one or more exemplary embodiments, the inspection unit may include: first transistors coupled between respective ones of the data lines that are coupled to the first pixels and a first inspection line, and that turn on in response to the second control signal; second transistors coupled between respective ones of the data lines that are coupled to the second pixels and a second inspection line, and that turn on in response to the second control signal; and third transistors coupled between respective ones of the data lines that are coupled to the third pixels, other than the specific data lines and a third inspection line, and that turn on in response to the second control signal.

According to one or more exemplary embodiments, the third transistors may be dual gate transistors.

According to one or more exemplary embodiments, at least one of the first transistors and the second transistors may be dual gate transistors.

According to one or more exemplary embodiments of the present disclosure, a method of inspecting a display device including an inspection unit configured to supply a plurality of inspection signals to a plurality of pixels, and at least one detection line having first and second ends that are electrically coupled to the inspection unit, includes: turning off a first control transistor between the first end of the at least one detection line and a specific data line, and turning off a second control transistor between the second end of the at least one detection line and an inspection line; turning on a reset transistor coupled between the at least one detection line and a reset power supply; supplying a data signal to the specific data line; and supplying a voltage from the inspection line to the specific data line by turning off the reset transistor and turning on the first control transistor and the second control transistor.

According to one or more exemplary embodiments, a voltage of the data signal may be a voltage corresponding to a gray level of white.

According to one or more exemplary embodiments, the voltage from the inspection line may be a voltage corresponding to a data signal of black.

According to one or more exemplary embodiments, the specific data line may be coupled to pixels of green.

According to one or more exemplary embodiments, a voltage of the reset power supply may be lower than that of the data signal.

According to one or more exemplary embodiments, the method may further include supplying a plurality of scan signals to a plurality of scan lines to activate a plurality of pixels coupled to the specific data line in a row when a voltage from the inspection line is supplied to the specific data line.

BRIEF DESCRIPTION OF THE DRAWINGS

Example embodiments are described more fully hereinafter with reference to the accompanying drawings; however, the present invention may be embodied in different forms and should not be construed as limited to the embodiments set forth herein. Rather, these embodiments are provided so that this disclosure will be thorough and complete, and will fully convey the scope of the example embodiments to those skilled in the art.

DETAILED DESCRIPTION

Figure 1:
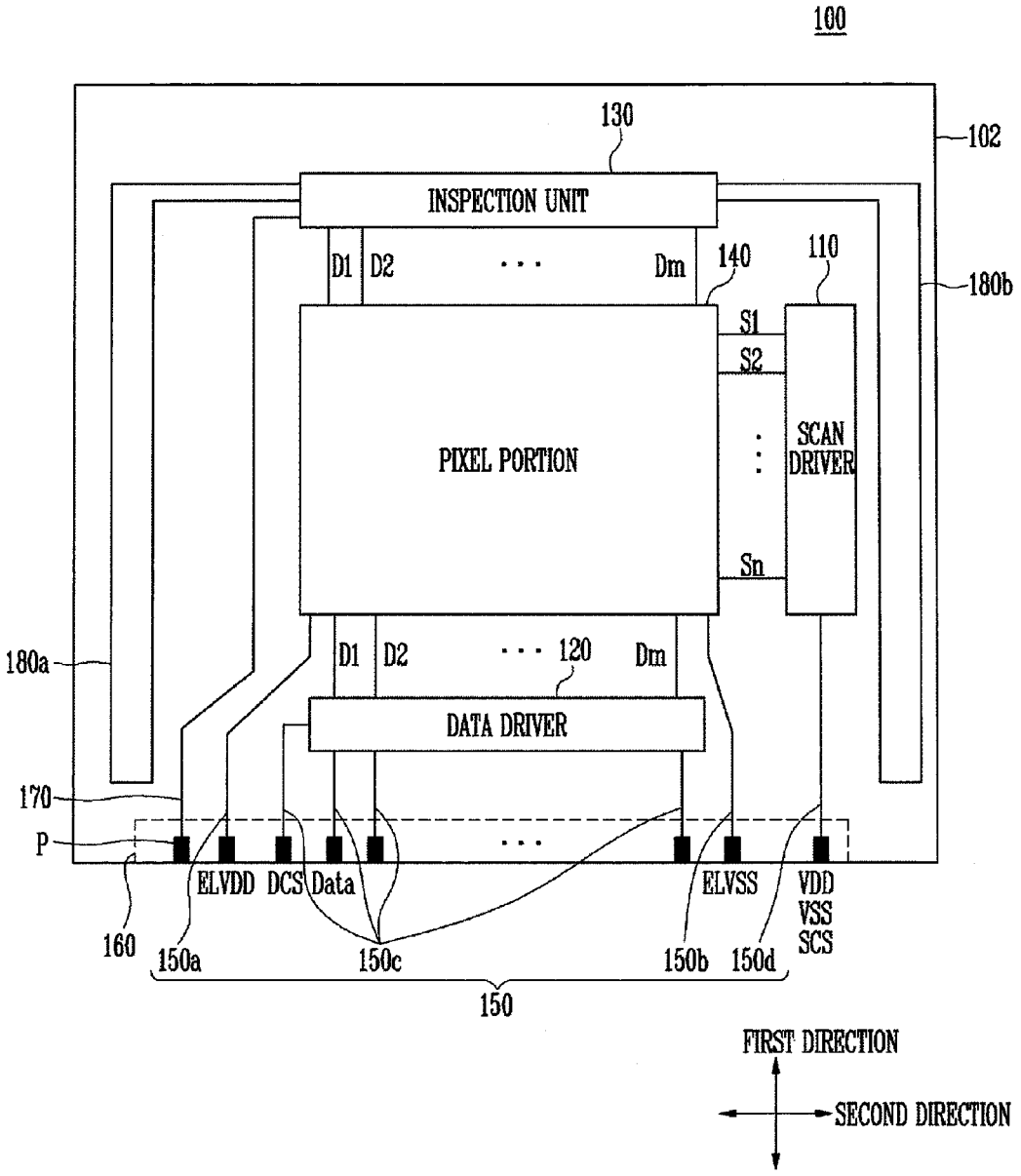
FIG. 1 is a schematic view of a display device according to one or more exemplary embodiments of the present disclosure.

Hereinafter, example embodiments are described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

As used herein, the phrase "supplying a signal" means that a voltage for turning on a transistor which receives the signal is supplied. In addition, stopping supply of a signal means that a voltage for turning off a transistor which receives the signal is supplied.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a schematic view of a display device according to one or more exemplary embodiments of the present disclosure.

Referring to FIG. 1, a display device 100 according to one or more exemplary embodiments of the present disclosure includes a panel 102, a scan driver 110, a data driver 120, an inspection unit 130, a pixel portion (i.e., a display region) 140, and a pad portion 160.

The display region 140 includes a plurality of pixels located at an area that is partitioned by a plurality of data lines D1 to Dm and a plurality of scan lines S1 to Sn. The plurality of pixels includes first pixels, second pixels, and third pixels which emit light of colors different from each other. The plurality of data lines D1 to Dm are formed in a first direction, and the plurality of scan lines S1 to Sn are formed in a second direction.

The scan driver 110 receives scan drive power supply voltages VDD and VSS and a scan control signal SCS from an external device via the pad portion 160. The scan driver 110 receives the scan drive power supply voltages VDD and VSS and the scan control signal SCS supplies a plurality of scan signals to the plurality of scan lines S1 to Sn. For example, the scan driver 110 may sequentially supply the plurality of scan signals to the plurality of scan lines S1 to Sn. In some embodiments, as illustrated in FIG. 1, the scan driver 110 may be coupled to one pad P, but the present disclosure is not limited thereto. For example, in some embodiments, the scan driver 110 may be coupled to a plurality of pads P corresponding to the scan drive power supply voltages VDD and VSS and the scan control signal SCS.

The data driver 120 is coupled to ends of the plurality of data lines D1 to Dm at one side (e.g., a first side) of the data lines D1 to Dm. The data driver 120 receives data Data and a data control signal DCS from an external device via the pad portion 160. The data driver 120 receives the data Data and the data control signal DCS, and generates a plurality of data signals in synchronization with the plurality of scan signals, and supplies the generated data signals to the plurality of data lines D1 to Dm. The data driver 120 may be formed in the panel 102, or may be produced as an integrated circuit and embedded in the panel 102.

The inspection unit 130 is coupled to ends of the plurality of data lines D1 to Dm at an opposite side (e.g., a second side) of the data lines D1 to Dm. During inspection of the panel 102, the inspection unit 130 receives inspection signals from an external device via the pad portion 160. The inspection unit 130 receives the inspection signals and performs various types of inspections, including a lighting inspection of the plurality of pixels. In addition, the inspection unit 130 may detect a crack of the panel 102 using detection lines 180*a* and 180*b*.

The pad portion 160 may include the plurality of pads P that transmit power supply voltages and/or signals, which are supplied from an external device, to the panel 102.

A non-display area of the panel 102 includes a first wire group 150, a second wire group 170, and the detection lines 180*a* and 180*b*, to which the power supply voltages and/or signals from the pad portion 160 are supplied.

The first wire group 150 includes a first wire 150*a*, a second wire 150*b*, a third wire 150*c*, and a fourth wire 150*d*. The first wire 150*a* receives a first power supply voltage ELVDD from an external device, and transmits the received first power supply voltage ELVDD to the display region 140. The second wire 150*b* receives a second power supply voltage ELVSS from an external device, and transmits the received second power supply voltage ELVSS to the display region 140.

The first power supply voltage ELVDD and the second power supply voltage ELVSS, which are supplied to the display region 140, are supplied to each of the pixels. Each of the pixels controls an amount of a current that is supplied from the first power supply voltage ELVDD to the second power supply voltage ELVSS in correspondence with the data signal, and emits light (e.g., light with a predetermined luminance). As such, the first power supply voltage ELVDD is set to a voltage value that is higher than that of the second power supply voltage ELVSS.

The third wire 150*c* receives the data Data and the data control signal DCS from an external device, and transmits the received data Data and the data control signal DCS to the data driver 120. As such, the third wire 150*c* may include a plurality of wires. The fourth wire 150*d* receives the scan drive power supply voltages VDD and VSS and the scan control signal SCS from an external device, and transmits the received scan drive power supply voltage and scan control signal to the scan driver 110. The scan drive power supply voltage VDD may be set to a high voltage, and the scan drive power supply voltage VSS may be set to a low voltage.

Although the fourth wire 150*d* is illustrated as one wire in FIG. 1, the present invention is not limited thereto, and the fourth wire 150*d* may include a plurality of wires. For example, the fourth wire 150*d* may include four or more wires in correspondence with the first scan drive power supply voltage VDD, the second scan drive power supply voltage VSS, a start pulse of the scan control signal SCS, and a clock signal.

The second wire group 170 receives control signals and the inspection signals, and supplies the control signals and the inspection signals to the inspection unit 130 in order to inspect the panel 102. As such, the second wire group 170 may include a plurality of wires. For example, the second wire group 170 may include four or more wires in correspondence with the control signals, an inspection signal of red, an inspection signal of green, and an inspection signal of blue.

The detection lines 180*a* and 180*b* are used for detecting a crack of the panel 102, and are configured as one or more wires. For convenience of description, FIG. 1 illustrates two detection lines 180*a* and 180*b*. The detection lines 180*a* and 180*b* are formed in an outer region of the panel 102, and couple one side (e.g., a first side) to another side (e.g., a second side) of the panel 102. Ends of the first side and ends of the second side of the detection lines 180*a* and 180*b* are electrically coupled to the inspection unit 130.

Because the detection lines 180*a* and 180*b* couple the first side of the panel 102 to the second side of the panel 102, the detection lines 180*a* and 180*b* have predetermined capacitances and resistances. In addition, the resistances of the detection lines 180*a* and 180*b* increase in correspondence with a crack of the panel 102.

In other words, when a crack is produced (or formed) in the panel 102, a crack is produced (or formed) in a metal that forms the detection lines 180*a* and 180*b*, for example, a source/drain metal. If a crack is produced (or formed) in the detection lines 180*a* and 180*b*, the resistances of the detection lines 180*a* and 180*b* increase, and accordingly, RC delays of the detection lines 180*a* and 180*b* increase.

In the display device according to one or more exemplary embodiments of the present disclosure, a crack of the panel 102 may be detected by using an increase of the resistances of the detection lines 180*a* and 180*b*, as described further below.

In addition, the panel 102 may further include a light emission control driver that supplies a light emission control signal in order to control light emission time of the plurality of pixels.

Figure 2:
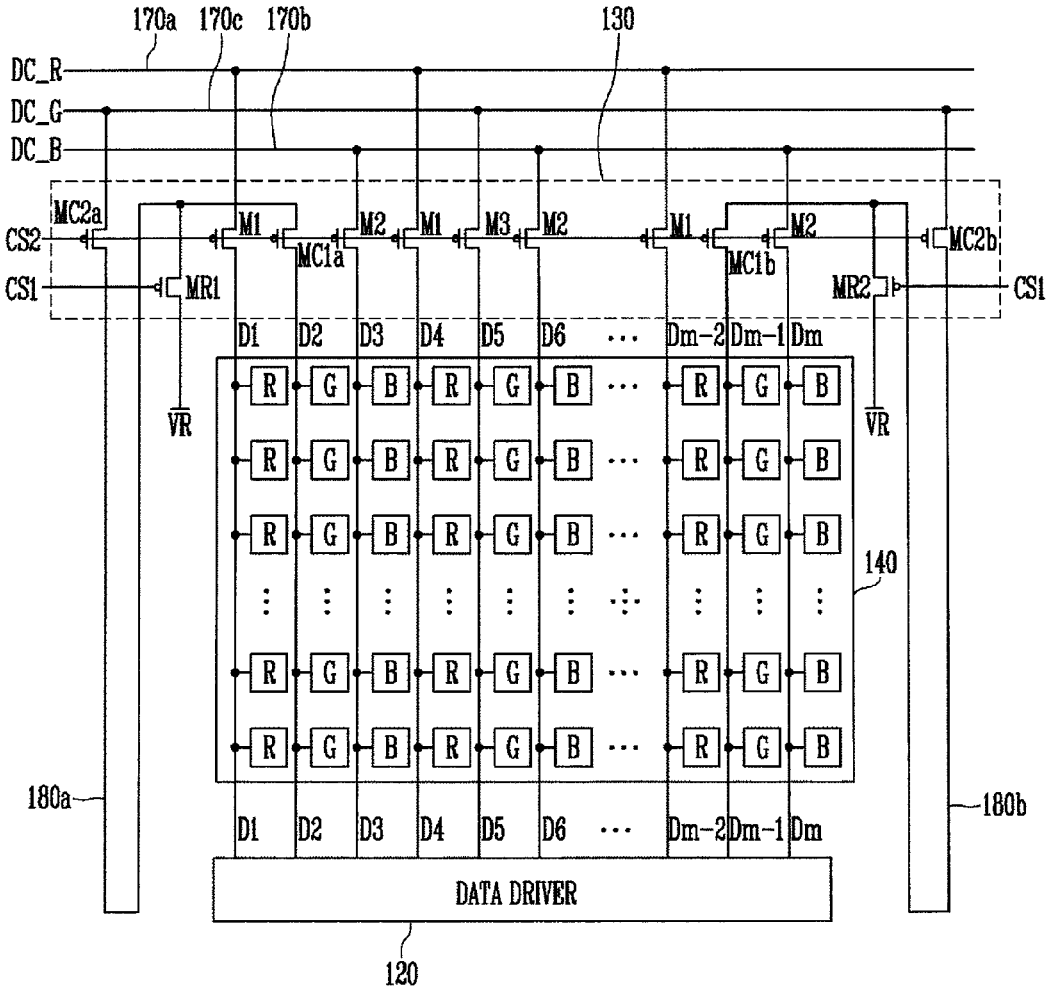
FIG. 2 is a schematic view of one or more exemplary embodiments of a display region and an inspection unit of the display device illustrated in FIG. 1.

FIG. 2 is a schematic view of one or more exemplary embodiments of the display region 140 and the inspection unit 130 which are illustrated in FIG. 1.

Referring to FIG. 2, the display region 140 includes first pixels R that display a first color, second pixels B that display a second color, and third pixels G that display a third color. The first pixels R may display red, the second pixels B may display blue, and the third pixels G may display green, for example. In other words, the first color may be red, the second color may be blue, and the third color may be green.

The first pixels R, the second pixels B, and the third pixels G are arranged in columns (or vertical line units) in the display region 140. Thus, each of the plurality of data lines D1 to Dm, which are also arranged in columns, are coupled to ones of the first pixels R, the second pixels B, or the third pixels G. In some embodiments, as illustrated in FIG. 2, the display region 140 may include pixels for displaying red, green, and blue. However, in some embodiments, the display region 140 may further include pixels for displaying colors other than red, green, and blue.

The inspection unit 130 includes a first inspection line 170*a*, a second inspection line 170*b*, and a third inspection line 170*c*. The first inspection line 170*a*, the second inspection line 170*b*, and the third inspection line 170*c* are included in the second wire group 170, and during inspection respectively receive an inspection signal of red DC_R, an inspection signal of blue DC_B, and an inspection signal of green DC_G, which are DC type signals.

First transistors M1 are formed between respective ones of first data lines D1, D4, . . . Dm-2 and the first inspection line 170*a*. When receiving a second control signal CS2, the first transistors M1 are turned on, thereby electrically coupling the first inspection line 170*a* to the first data lines D1, D4, . . . Dm-2. The first data lines D1, D4, . . . Dm-2 are data lines that are coupled to the first pixels R.

Second transistors M2 are formed between respective ones of second data lines D3, D6, . . . Dm and the second inspection line 170*b*. When receiving the second control signal CS2, the second transistors M2 are turned on, thereby electrically coupling the second inspection line 170*b* to the second data lines D3, D6, . . . Dm. The second data lines D3, D6, . . . Dm are data lines that are coupled to the second pixels B.

Third transistors M3 are formed between respective ones of third data lines D5, . . . and the third inspection line 170*c*. When receiving the second control signal CS2, the third transistors M3 are turned on, thereby electrically coupling the third inspection line 170*c* to the third data lines D5, . . . . The third data lines D5, . . . are data lines that are coupled to the third pixels G. However, the third data lines D5, . . . do not include specific data lines D2 and Dm-1, which are respectively electrically coupled to the detection lines 180*a* and 180*b*.

First control transistors MC1*a* and MC1*b* are respectively coupled between the ends of a first side of the detection lines 180*a* and 180*b* and the specific data lines D2 and Dm-1. For example, one of the first control transistors MC1*a* may be coupled between the first detection line 180*a* and the second data line D2, and is turned on when it receives (or in response to) the second control signal CS2. The other of the first control transistors MC1*b* may be coupled between the second detection line 180*b* and the (m−1)th data line Dm-1, and is turned on in response to the second control signal CS2.

The specific data lines D2 and Dm-1, which are respectively coupled to the detection lines 180*a* and 180*b*, may be used to detect a crack, and may be coupled to the third pixels G, which have high visibility. In some embodiments, as illustrated in FIG. 2, the specific data lines may be the second data line D2 and the (m−1)th data line Dm-1, but the present disclosure is not limited thereto. For example, in some embodiments, the specific data lines may be selected as any one of the data lines D2, D5, . . . Dm-1 that are coupled to the third pixels G. In addition, in some embodiments, the specific data lines may be coupled to the third pixels G, but the specific data lines may be selected as any one of the data lines D1, D3, D4, D6, . . . Dm-2, Dm that are coupled to the first pixels R or the second pixels B.

Second control transistors MC2*a* and MC2*b* are coupled between the ends of a second side (e.g., a second side opposite to the first side) of the detection lines 180*a* and 180*b* and the third inspection line 170*c*. For example, one of the second control transistors MC2*a* may be coupled between the first detection line 180*a* and the third inspection line 170*c*, and is turned on when it receives the second control signal CS2. The other of the second control transistors MC2*b* may be coupled between the second detection line 180*b* and the third inspection line 170*c*, and is turned on when it receives the second control signal CS2.

First and second reset transistors MR1 and MR2 are respectively coupled between the detection lines 180*a* and 180*b* and a reset power supply VR. For example, the first reset transistor MR1 may be coupled between the first detection line 180*a* and the reset power supply VR, and is turned on when it receives the first control signal CS1. In addition, the second reset transistor MR2 may be coupled between the second detection line 180*b* and the reset power supply VR, and is turned on when it receives the first control signal CS1.

Here, a voltage of the reset power supply VR is set to a voltage that is lower than that of the data signal, for example, a voltage that is lower than a data signal of white. For example, the voltage of the reset power supply VR may be set to the second power supply voltage ELVSS or the second scan drive power supply voltage VSS.

In addition, the first control signal CS1 does not overlap with the second control signal CS2. Thus, the turn-on periods of the first and second reset transistors MR1 and MR2 do not overlap with the turn-on periods of the control transistors MC1*a*, MC1*b*, MC2*a*, and MC2*b*.

A lighting inspection process is described below. First, the second control signal CS2 is supplied, and thereby the transistors M1, M2, and M3 and the control transistors MC1*a*, MC1*b*, MC2*a*, and MC2*b* are turned on. If the transistors M1, M2, and M3 and the control transistors MC1*a*, MC1*b*, MC2*a*, and MC2*b* are turned on, the inspection lines 170*a*, 170*b*, and 170*c* are respectively coupled to the plurality of data lines D1 to Dm.

For example, the first inspection line 170*a* is coupled to the first data lines D1, D4, . . . , Dm-2 and accordingly, the inspection signal of red DC_R is supplied to the first data lines D1, D4, . . . Dm-2. The second inspection line 170*b* is coupled to the second data lines D3, D6, . . . Dm, and accordingly, the inspection signal of blue DC_B is supplied to the second data lines D3, D6, . . . Dm. The third inspection line 170*c* is coupled to the third data lines D5, . . . and the specific data lines D2 and Dm-1. Accordingly, the inspection signal of green DC_G is supplied to the third data lines D5, . . . and the specific data lines D2 and Dm-1.

Subsequently, the inspection signals DC_R, DC_B, and DC_G are supplied to the pixels R, G, and B in response to the scan signals from the scan driver 110. Accordingly, the pixels R, G, and B emit light corresponding to the inspection signals DC_R, DC_B, and DC_G. The lighting inspection is general, and may be performed by various methods which are known in the art.

Figure 3:
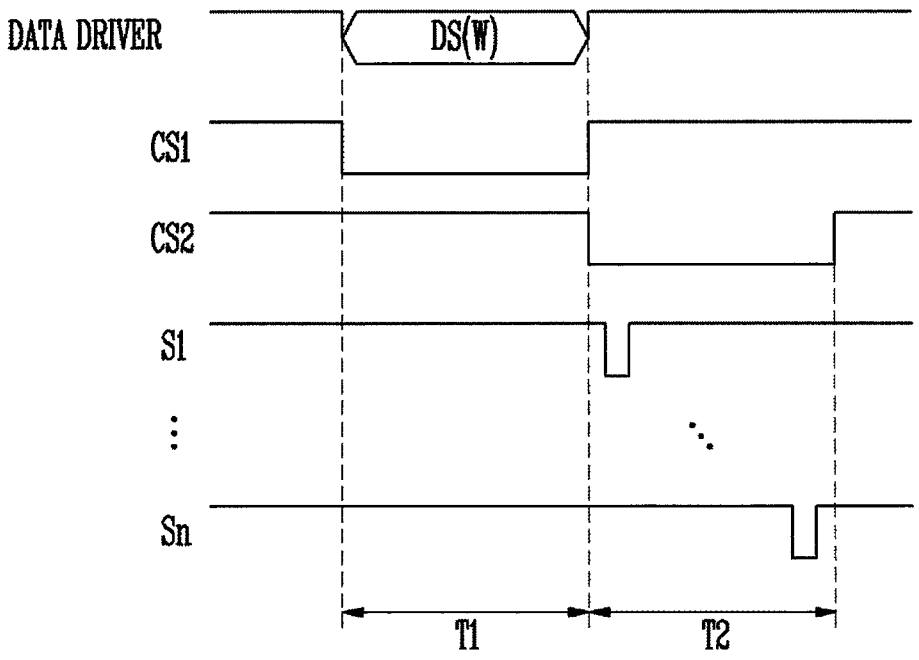
FIG. 3 is a diagram illustrating a method of inspecting a crack according to one or more embodiments of the present disclosure.

FIG. 3 is a diagram illustrating a method of inspecting a crack according to one or more exemplary embodiments of the present disclosure.

Referring to FIG. 3, during a crack inspection period, a crack of the panel 102 may be detected. During a first period T1 of the crack inspection period, the data signal of white DS(W) is supplied from the data driver 120 to the plurality of data lines D1 to Dm. If the data signal of white DS(W) is supplied from the data driver 120 to the plurality of data lines D1 to Dm, voltages of the plurality of data lines D1 to Dm are initialized to a voltage of the data signal of white DS(W). In some embodiments, when the transistors of the pixels R, G, and B are PMOS transistors, the data signal of white DS(W) is set to the lowest voltage among the voltages of the data signals which are supplied from the data driver 120. In addition, the data driver 120 may supply only the data lines coupled to the third pixels G, that is, the third data lines D5, . . . and the specific data lines D2 and Dm-1 with the data signal of white, during the first period T1.

In addition, during the first period T1, the first control signal CS1 is supplied and thereby the reset transistors MR1 and MR2 are turned on. When the reset transistors MR1 and MR2 are turned on, the voltage of the reset power supply VR is supplied to the detection lines 180*a* and 180*b*. That is, during the first period T1, the voltages of the detection lines 180*a* and 180*b* are initialized to the voltage of the reset power supply VR.

During a second period T2 of the crack inspection period, the second control signal CS2 is supplied. As such, the control transistors MC1*a*, MC1*b*, MC2*a*, and MC2*b*, the first transistors M1, the second transistors M2, and the third transistors M3 are turned on.

When the first transistors M1 are turned on, the first inspection line 170*a* is coupled to the first data lines D1, D4, . . . Dm-2, and accordingly the inspection signal DC_R is supplied to the first data lines D1, D4, . . . Dm-2. When the second transistors M2 are turned on, the second inspection line 170*b* is coupled to the second data lines D3, D6, . . . Dm, and accordingly the inspection signal DC_B is supplied to the second data lines D3, D6, . . . Dm. When the third transistors M3 are turned on, the third inspection line 170*c* is coupled to the third data lines D5, . . . , and accordingly the inspection signal DC_G is supplied to the third data lines D5, . . . . Here, during the second period T2, voltages corresponding to the data signals of black are supplied as the inspection signals DC_R, DC_B, and DC_G.

When one of the first control transistors MC1*a* and one of the second control transistors MC2*a* are turned on, the inspection signal DC_G from the third inspection line 170*c* is supplied to the second data line D2 via the first detection line 180*a*. Accordingly, the voltage of the first detection line 180*a* increases from the voltage of the reset power supply VR to the voltage of the inspection signal DC_G, that is, the voltage of a data signal of black.

When the other of the first control transistors MC1*b* and the other of the second control transistors MC2*b* are turned on, the inspection signal DC_G from the third inspection line 170*c* is supplied to the (m−1)th data line Dm-1 via the second detection line 180*b*. Accordingly, the voltage of the second detection line 180*b* increases from the voltage of the reset power supply VR to the voltage of the inspection signal DC_G, that is, the voltage of the data signal of black.

Meanwhile, during the second period T2, the scan driver 110 sequentially supplies the scan signals to the plurality of scan lines S1 to Sn. Accordingly, the data signals of black from the plurality of data lines D1 to Dm are supplied to the pixels R, G, and B by a horizontal line unit (e.g., are supplied in a row), and accordingly, the pixels R, G, and B display a gray level of black. In addition, during the second period T2, the voltage of the data signal of black may be supplied only to the third inspection line 170*c*.

Figure 4A:
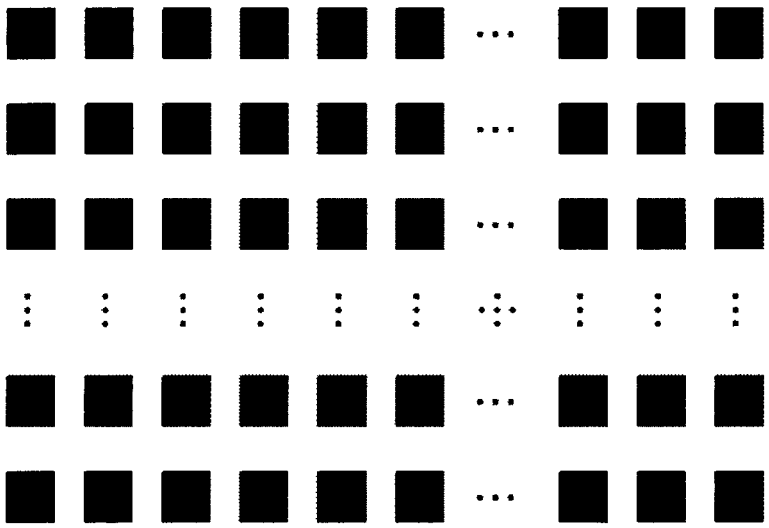
FIGS. 4A-4C are schematic diagrams illustrating display luminance of pixels according to the method of inspecting a crack.

If a crack has not been formed in the panel 102, the pixels R, G, and B display the gray level of black during the second period T2, as illustrated in FIG. 4A.

Figure 4B:
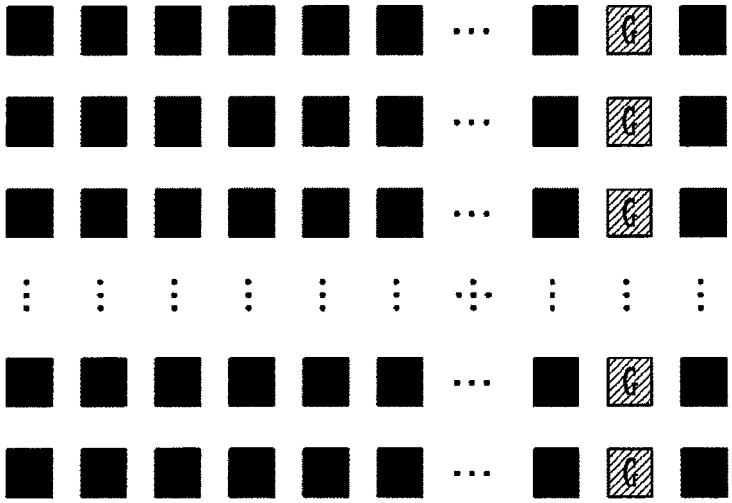
Figure 4C:
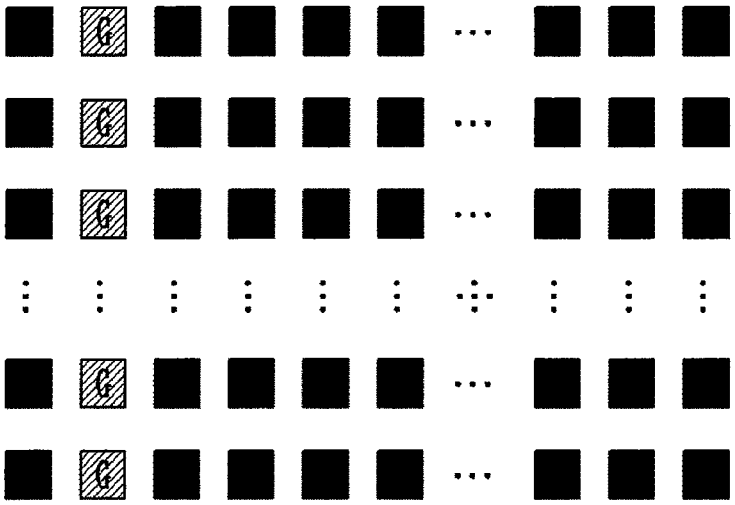

However, if a crack has formed in the panel 102, the pixels G that are coupled to one or both of the specific data lines D2 and/or Dm-1 emit light of a predetermined gray level, as illustrated in FIG. 4B and/or FIG. 4C. In more detail, if a crack is produced in the panel 102, the resistance of one or both of the detection lines 180*a* and/or 180*b* increases. If the resistance of one or both of the detection lines 180*a* and/or 180*b* increases, an amount of time in which the voltage of the detection line increases from the voltage of the reset power supply VR to the voltage of the data signal of black also increases.

That is, when (or if) a crack is formed in the panel 102, the voltage of the detection line 180*a* or 180*b* does not increase to the voltage of the data signal of black during the second period T2, and accordingly, the pixels G that are coupled to the specific data line D2 or Dm-1 do not display the gray level of black. Thus, in the display device according to one or more embodiments of the present disclosure, during the crack inspection period, the crack of the panel 102 may be detected by utilizing a light emission state of the pixels G that are coupled to the specific data lines D2 and Dm-1.

In addition, in the display device according to one or more exemplary embodiments of the present disclosure, the voltages of the detection lines 180*a* and 180*b* are decreased to the voltage of the reset power supply VR by the reset transistors MR1 and MR2, and thus reliability of operation may be ensured or improved. For example, if the voltage of the reset power supply VR is not supplied to the detection lines 180*a* and 180*b* during the first period T1, the voltage of the detection lines 180*a* and 180*b* may increase to the voltage of the data signal of black, even though the crack is formed in the panel 102.

Figure 5:
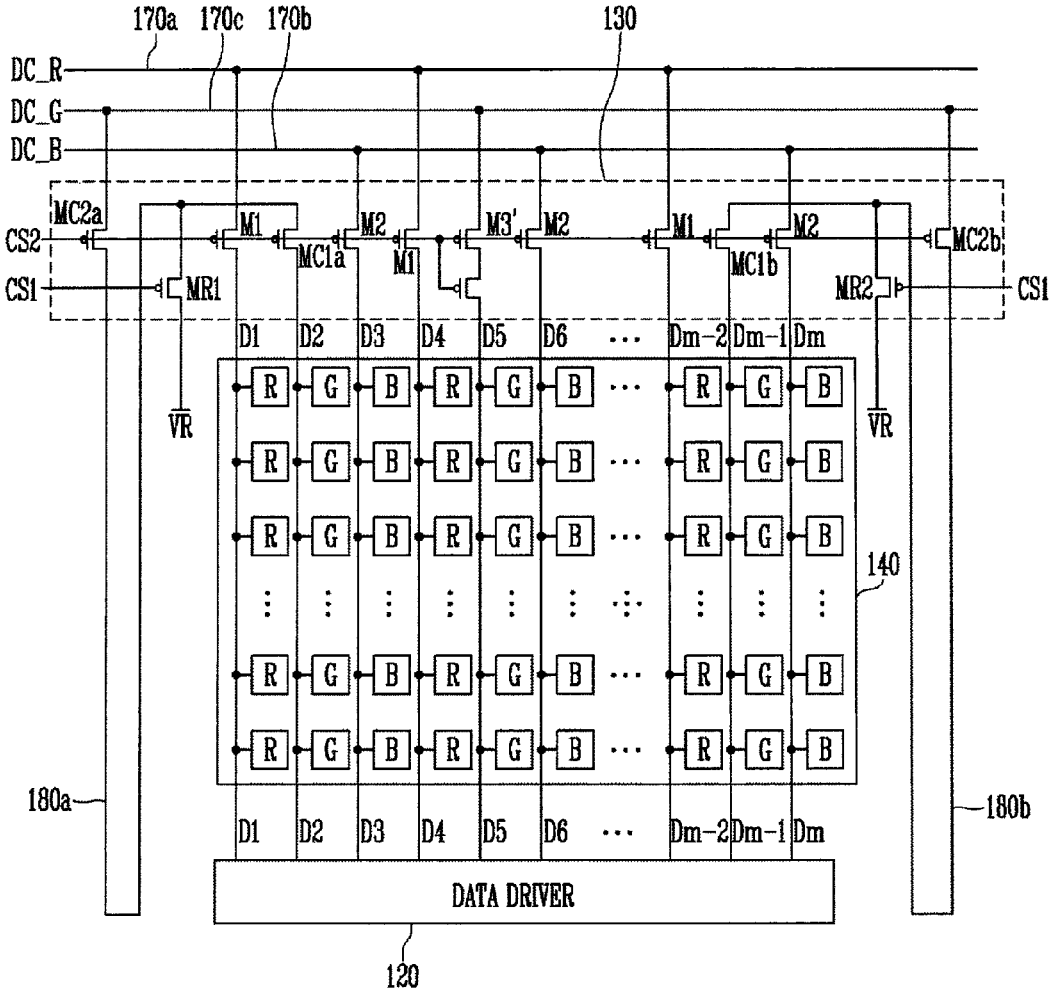
FIG. 5 is a schematic view of one or more exemplary embodiments of the display region and the inspection unit of the display device illustrated in FIG. 1.

FIG. 5 is a schematic view of one or more exemplary embodiments of the display region and the inspection unit which are illustrated in FIG. 1. In FIG. 5, like symbols or reference numerals refer to like elements as those in FIG. 2, and additional description thereof may be omitted.

Referring to FIG. 5, in some embodiments of the present disclosure, third transistors M3' of the inspection unit 130 may be configured as dual gate transistors. In more detail, each of the specific data lines D2 and Dm-1, which are used for detecting a crack of the panel 102, is coupled to two transistors MC1*a* and MC2*a*, or MC1*b* and MC2*b*.

As such, when each of the third data lines D5, . . . , which are coupled to the third pixels G, excluding the specific data lines D2 and Dm-1, is coupled to one of the third transistors M3', reliability of the lighting inspection may decrease. In other words, at the time of the lighting inspection, the third pixels G that are coupled to the specific data lines D2 and Dm-1 may emit light with luminance that is different from that of the pixels G coupled to the third data lines D5, . . . . Thus, in some embodiments of the present disclosure, by configuring the third transistors M3' as dual gate transistors, the third pixels G that are coupled to the specific data lines D2 and Dm-1 may have uniform brightness characteristics relative to the pixels G that are coupled to the third data lines D5, . . . .

Figure 6:
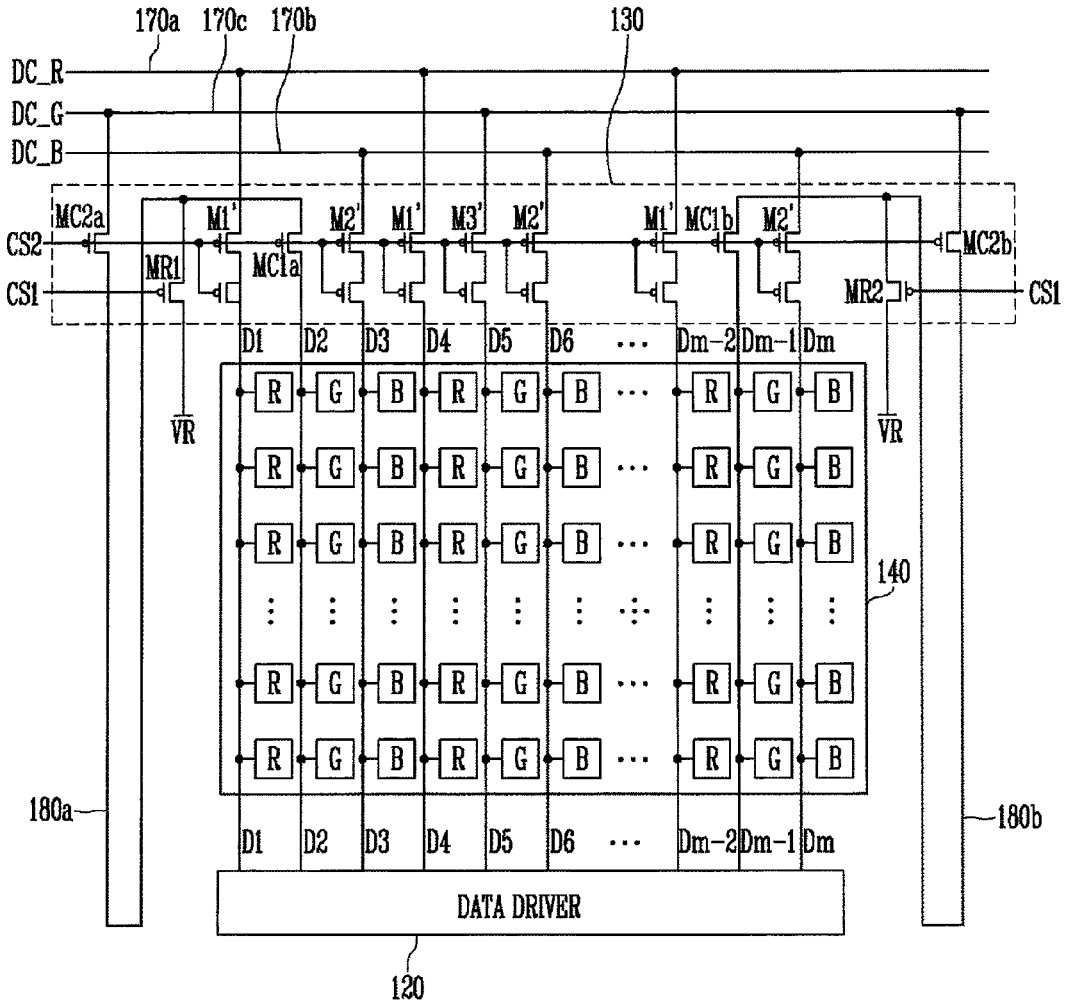
FIG. 6 is a schematic view of one or more exemplary embodiments of the display region and the inspection unit of the display device illustrated in FIG. 1.

FIG. 6 is a schematic view of one or more exemplary embodiments of the display region and the inspection unit which are illustrated in FIG. 1. In FIG. 6, like symbols or reference numerals refer to like elements as those in FIG. 2, and additional description thereof may be omitted.

Referring to FIG. 6, in some exemplary embodiments of the present disclosure, first transistors M1' second transistors M2', and the third transistors M3' of the inspection unit 130 are configured as dual gate transistors.

In more detail, each of the specific data lines D2 and Dm-1, which are used for detecting a crack of the panel 102, is coupled to two transistors MC1*a* and MC2*a*, or MC1*b* and MC2*b*, and the data lines other than the specific data lines D2 and Dm-1 are coupled to the first second, or third transistors M1, M2, or M3. Accordingly, during lighting inspection, luminance deviation may be generated between the pixels G coupled to the specific data lines D2 and Dm-1 and the pixels R, G, and B coupled to the data lines other than the specific data lines D2 and Dm-1. Thus, in some embodiments of the present disclosure, by configuring the first transistors M1', the second transistors M2', and the third transistors M3' as dual gate transistors, the pixels R, G, and B may have uniform brightness characteristics.

Figure 7:
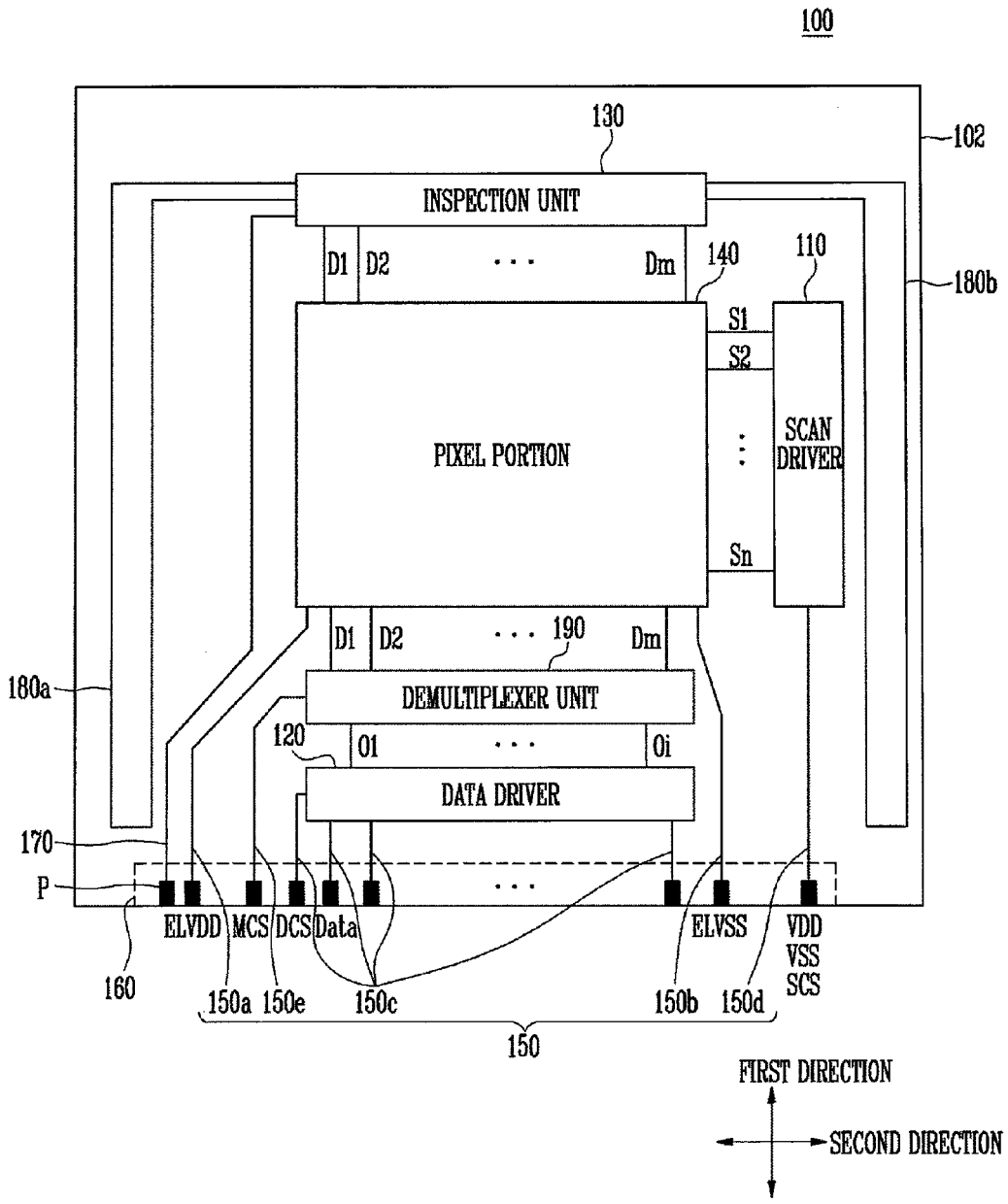
FIG. 7 is a schematic diagram illustrating a display device according to one or more exemplary embodiments of the present disclosure.

FIG. 7 is a schematic diagram illustrating a display device according to one or more exemplary embodiments of the present disclosure. In FIG. 7, like symbols or reference numerals refer to like elements as those in FIG. 1, and additional description thereof may be omitted.

Referring to FIG. 7, in some embodiments, the display device may further include a demultiplexer unit 190, which is coupled between the plurality of data lines D1 to Dm and the data driver 120.

The demultiplexer unit 190 supplies a plurality of data signals, which are supplied to each of a plurality of output lines O1 to Oi by the data driver 120, to the plurality of data lines. For example, the demultiplexer unit 190 may separately supply three data signals, which are supplied to the first output line O1 to the first data line D1, the second data line D2, and the third data line D3.

The first wire group 150 may further include a fifth wire 150*e*. The fifth wire 150*e* may supply a multiplexer control signal MCS from an external device to the demultiplexer unit 190. In some embodiments, the fifth wire 150*e* may be configured as a plurality of wires.

Figure 8:
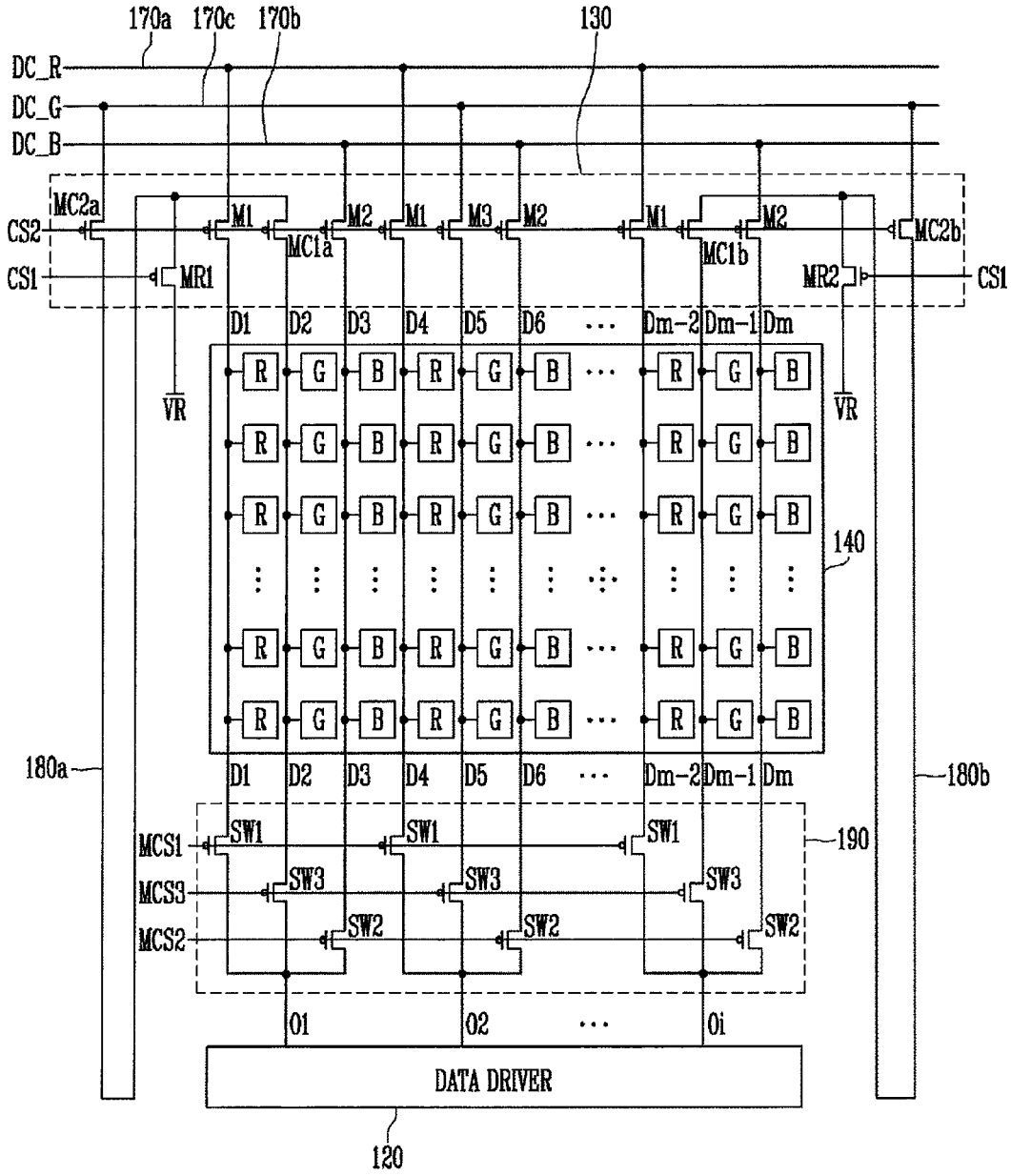
FIG. 8 is a schematic view of one or more exemplary embodiments of a demultiplexer unit of the display device illustrated in FIG. 7.

FIG. 8 is a diagram illustrating one or more embodiments of the demultiplexer unit illustrated in FIG. 7. As illustrated in FIG. 8, in some embodiments, the demultiplexer unit 190 may include three switching elements SW1 to SW3, but the present disclosure is not limited thereto. For example, the switching elements of the demultiplexer unit 190 may be configured as two or more switching elements.

Referring to FIG. 8, in some embodiments, the demultiplexer unit 190 may include the first switching elements SW1, the second switching elements SW2, and the third switching elements SW3.

The first switching elements SW1 are coupled between respective ones of the first data lines D1, D4, . . . Dm-2 and the data driver 120. The first switching elements SW1 are turned on when they receive (or in response to) a first multiplexer control signal MCS1.

The second switching elements SW2 are coupled between respective ones of the second data lines D3, D6, . . . Dm and the data driver 120. The second switching elements SW2 are turned on when they receive a second multiplexer control signal MCS2.

The third switching elements SW3 are coupled between each of fourth data lines D2, D5, . . . Dm-1 and the data driver 120. The third switching elements SW3 are turned on when receiving a third multiplexer control signal MCS3. The fourth data lines D2, D5, . . . Dm-1 refer to the data lines that are coupled to the third pixels G (i.e., the third data lines D5, . . . and the specific data lines D2 and Dm-1).

During one horizontal period, the first to third switching elements SW1 to SW3 are sequentially or non-sequentially turned on, and transmit three data signals, which are supplied to each of the plurality of output lines O1 to Oi to the three data lines (e.g., to the first, second and fourth data lines).

Figure 9:
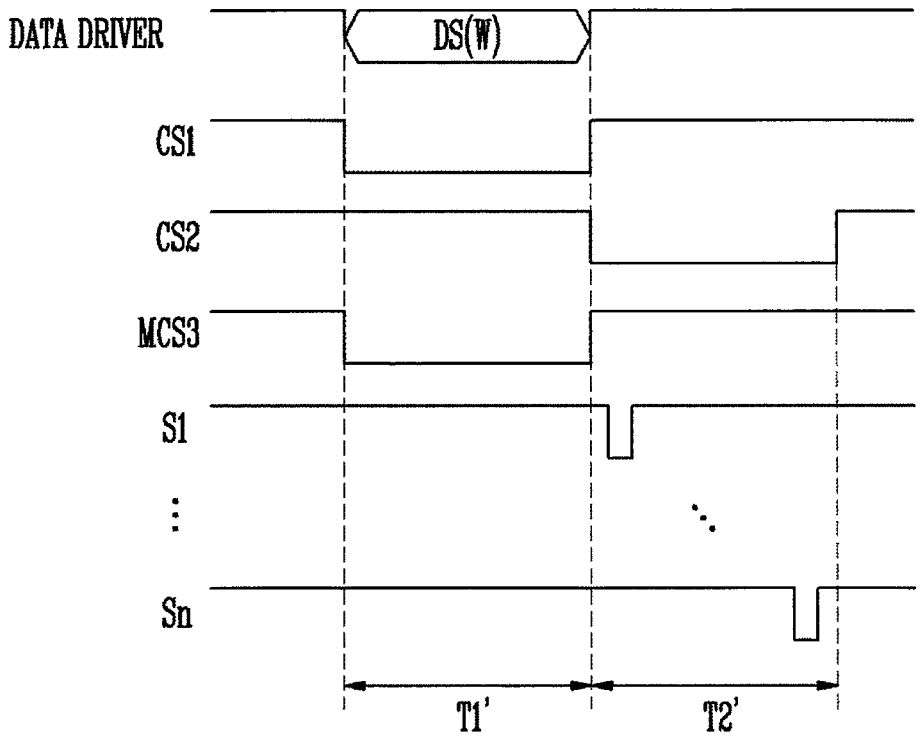
FIG. 9 is a diagram illustrating a method of inspecting a crack according to one or more exemplary embodiments of the present disclosure.

FIG. 9 is a diagram illustrating a method of inspecting a crack according to one or more exemplary embodiments of the present disclosure.

Referring to FIG. 9, during a first period T1' of the crack inspection period, the third multiplexer control signal MCS3 is received by the third switching elements SW3, thereby turning on the third switching elements SW3. As such, during the first period T1', the data signals of white DS(W) from the data driver 120 are supplied to the third pixels G. In addition, during the first period T1', the first multiplexer control signal MCS1 and the second multiplexer control signal MCS2 may be sequentially supplied so as not to overlap with the third multiplexer control signal MCS3. Accordingly, the data signals of white from the data driver 120 are supplied to the first pixels R, the second pixels B, and the third pixels G.

In addition, during the first period T1', the first control signal CS1 is supplied and thereby the reset transistors MR1 and MR2 are turned on. When the reset transistors MR1 and MR2 are turned on, the voltage of the reset power supply VR is supplied to the detection lines 180*a* and 180*b*. That is, during the first period T1', the voltage of the detection lines 180*a* and 180*b* is initialized to the voltage of the reset power supply VR.

During a second period T2' of the crack inspection period, the second control signal CS2 is supplied. When the second control signal CS2 is supplied, the control transistors MC1*a*, MC1*b*, MC2*a*, and MC2*b*, the first transistors M1, the second transistors M2, the third transistors M3 are turned on.

When the first transistors M1 are turned on, the first inspection line 170*a* is coupled to the first data lines D1, D4, . . . , Dm-2 and accordingly the inspection signal DC_R is supplied to the first data lines D1, D4, . . . Dm-2. When the second transistors M2 are turned on, the second inspection line 170*b* is coupled to the second data lines D3, D6, . . . Dm, and accordingly the inspection signal DC_B is supplied to the second data lines D3, D6, . . . . When the third transistors M3 are turned on, the third inspection line 170*c* is coupled to the third data lines D5, . . . , and accordingly the inspection signal DC_G is supplied to the third data lines D5, . . . . Here, during the second period T2', the voltages corresponding to the data signals of black are supplied as the inspection signals DC_R, DC_B, and DC_G. In addition, during the second period T2', the voltage of the data signal of black may be supplied only to the third inspection line 170*c*.

When one of the first control transistors MC1*a* and one of the second control transistors MC2*a* are turned on, the inspection signal DC_G from the third inspection line 170*c* is supplied to the second data line D2 via the first detection line 180*a*. Accordingly, the voltage of the first detection line 180*a* increases from the voltage of the reset power supply VR to the voltage of the inspection signal DC_G, that is, the voltage of the data signal of black.

When the other of the first control transistors MC1*b* and the other of the second control transistors MC2*b* are turned on, the inspection signal DC_G from the third inspection line 170*c* is supplied to the (m−1)th data line Dm-1 via the second detection line 180*b*. Accordingly, the voltage of the second detection line 180*b* increases from the voltage of the reset power supply VR to the voltage of the inspection signal DC_G, that is, the voltage of the data signal of black.

Meanwhile, during the second period T2', the scan driver 110 sequentially supplies the scan signals to the plurality of scan lines S1 to Sn. Accordingly, the data signals of black from the plurality of data lines D1 to Dm are supplied to the pixels R, G, and B by a horizontal line unit (e.g., are supplied to the pixels R, G, and B in a row), and accordingly, the pixels R, G, and B display a gray level of black.

When (if) a crack has not been formed in the panel 102, the pixels R, G, and B display the gray level of black during the second period T2', as illustrated in FIG. 4A.

However, when (if) a crack has been formed in the panel 102, the pixels G coupled to one or both of the specific data lines D2 and/or Dm-1 emit light of a gray level (e.g., a predetermined gray level), as illustrated in FIG. 4B and/or FIG. 4C. In more detail, if a crack is formed in the panel 102, the resistance of one or both of the detection lines 180*a* and/or 180*b* increases. If the resistance of one or both of the detection lines 180*a* and/or 180*b* increases, a period of time in which the voltage of the detection line increases from the voltage of the reset power supply VR to the voltage of the data signal of black also increases.

That is, when a crack is produced in the panel 102, the voltage of the detection line 180*a* or 180*b* does not increase to the voltage of the data signal of black during the second period T2', and accordingly, the pixels G that are coupled to the specific data line D2 or Dm-1 do not display the gray level of black. Thus, according to one or more exemplary embodiments of the present disclosure, during the crack inspection period, the crack of the panel 102 may be detected by using a light emission state of the pixels G that are coupled to the specific data lines D2 and Dm-1.

In some embodiments, as described above, the transistors may be configured as PMOS transistors, but the present disclosure is not limited thereto. For example, in some embodiments, the transistors may be configured as NMOS transistors.

According to a display device and a method of inspecting the display device according to one or more embodiments of the present disclosure, a crack of a panel can be detected by using a detection line, which is formed from one side of the panel to the other side of the panel. Particularly, in some embodiments of the present disclosure, a reset voltage is supplied to the detection line by using a reset transistor that is coupled to the detection line, and thereby reliability of crack detection may be ensured.

Example embodiments have been disclosed herein, and although specific terms are used, they are used and are to be interpreted in a generic and descriptive sense and not for purpose of limitation. In some instances, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A display device comprising:

a plurality of pixels located at crossing regions of a plurality of scan lines and a plurality of data lines;

a data driver coupled to ends of the plurality of data lines at a first side and configured to supply a plurality of data signals to the plurality of data lines;

an inspection unit coupled to ends of the plurality of data lines at a second side and configured to supply a plurality of inspection signals to the plurality of pixels;

detection lines electrically coupled to the inspection unit and extending from a first side of a panel to a second side of the panel; and a reset transistor coupled between one of the detection lines and a reset power supply and configured to be turned on in response to a first control signal, wherein the inspection unit comprises:

a first control transistor coupled between ends of a first side of the detection lines and a specific data line coupled to at least one pixel of the plurality of pixels, the first control transistor being configured to be turned on in response to a second control signal; and a second control transistor coupled between ends of a second side of the detection lines and an inspection line that is configured to supply an inspection signal to the at least one pixel, the second control transistor being configured to be turned on in response to the second control signal.

2. The display device according to claim 1, wherein a voltage of the reset power supply is lower than that of the data signals supplied from the data driver.

3. The display device according to claim 2, wherein the voltage of the reset power supply is lower than that of a data signal of white.

4. The display device according to claim 1, further comprising a scan driver configured to supply a plurality of scan signals to the plurality of scan lines.

5. The display device according to claim 4, wherein the plurality of pixels comprises:

first pixels configured to display a first color;

second pixels configured to display a second color; and third pixels configured to display a third color.

6. The display device according to claim 5, wherein the first color is red, the second color is blue, and the third color is green.

7. The display device according to claim 5, wherein the data driver is configured to supply a data signal of white when the first control signal is supplied during a first period of inspection, and wherein a voltage corresponding to a data signal of black is supplied to the inspection line and the scan driver sequentially supplies the plurality of scan signals to the plurality of scan lines when the second control signal is supplied during a second period of inspection.

8. The display device according to claim 7, further comprising a demultiplexer unit coupled between the data driver and the plurality of data lines.

9. The display device according to claim 8, wherein the demultiplexer unit comprises:

first switching elements coupled to respective ones of the data lines that are coupled to the first pixels;

second switching elements coupled to respective ones of the data lines that are coupled to the second pixels; and third switching elements coupled to respective ones of the data lines that are coupled to the third pixels, and wherein the inspection line is coupled to at least one of the third pixels, and the third switching elements are turned on during the first period.

10. The display device according to claim 5, wherein the inspection unit further comprises:

first transistors coupled between respective ones of the data lines that are coupled to the first pixels and a first inspection line, and configured to be turned turn on in response to the second control signal;

second transistors coupled between respective ones of the data lines that are coupled to the second pixels and a second inspection line, and configured to be turned on in response to the second control signal; and third transistors coupled between respective ones of the data lines that are coupled to the third pixels, other than the specific data line and the inspection line that is coupled to the second control transistor, and configured to be turned on in response to the second control signal.

11. The display device according to claim 10, wherein the third transistors are dual gate transistors.

12. The display device according to claim 10, wherein at least one of the first transistors and the second transistors are dual gate transistors.

13. The display device according to claim 1, wherein the first control signal does not overlap with the second control signal.

14. A method of inspecting a display device comprising an inspection unit configured to supply a plurality of inspection signals to a plurality of pixels, and at least one detection line having first and second ends that are electrically coupled to the inspection unit, the method comprising:

turning off a first control transistor between the first end of the at least one detection line and a specific data line, and turning off a second control transistor between the second end of the at least one detection line and an inspection line;

turning on a reset transistor coupled between the at least one detection line and a reset power supply;

supplying a data signal to the specific data line; and supplying a voltage from the inspection line to the specific data line by turning off the reset transistor and turning on the first control transistor and the second control transistor.

15. The method of inspecting the display device according to claim 14, wherein a voltage of the data signal is a voltage corresponding to a gray level of white.

16. The method of inspecting the display device according to claim 14, wherein the voltage from the inspection line is a voltage corresponding to a data signal of black.

17. The method of inspecting the display device according to claim 14, wherein the specific data line is coupled to pixels of green.

18. The method of inspecting the display device according to claim 14, wherein a voltage of the reset power supply is lower than that of the data signal.

19. The method of inspecting the display device according to claim 14, further comprising:

supplying a plurality of scan signals to a plurality of scan lines to activate a plurality of pixels coupled to the specific data line in a row when a voltage from the inspection line is supplied to the specific data line.

* * * * *